US005723214A

United States Patent [19]

Yamazaki et al.

[11] Patent Number: 5,723,214

[45] Date of Patent: Mar. 3, 1998

[54] PAPER FEED ROLL AND APPARATUS

[75] Inventors: Hirotaka Yamazaki, Kunitachi; Yasushi Imai, Kodaira; Shinichi Toyosawa, Tokorozawa; Yoshihide Fukahori, Hachioji, all of Japan

[73] Assignee: Bridgestone Corporation, Tokyo, Japan

[21] Appl. No.: 442,757

[22] Filed: May 17, 1995

[30] Foreign Application Priority Data

May 18, 1994 [JP] Japan ..... 6-104172
Jul. 29, 1994 [JP] Japan ..... 6-179269

[51] Int. Cl.[6] ..... D02G 3/00

[52] U.S. Cl. ..... 428/364; 428/375; 428/451; 428/494; 428/520; 428/522; 428/424.2; 428/424.8; 492/56; 492/59

[58] Field of Search ..... 428/391, 375, 428/379, 392, 364, 451, 424.2, 424.8, 494, 520, 522; 492/53, 56, 59

[56] References Cited

U.S. PATENT DOCUMENTS

| | | | |
|---|---|---|---|
| 4,029,629 | 6/1977 | Jeram . | |
| 4,147,832 | 4/1979 | Namiki . | |
| 4,431,701 | 2/1984 | Hamada et al. | 428/379 |
| 4,707,408 | 11/1987 | Iwasawa et al. | 428/379 |
| 5,039,080 | 8/1991 | Kato et al. . | |
| 5,052,836 | 10/1991 | Genno . | |
| 5,232,211 | 8/1993 | Kubota et al. . | |
| 5,376,448 | 12/1994 | Suzuki et al. | 428/372 |
| 5,451,454 | 9/1995 | Fukahori . | |
| 5,482,775 | 1/1996 | Miyabayashi | 428/379 |

FOREIGN PATENT DOCUMENTS

| | | |
|---|---|---|
| 0612804A2 | 8/1994 | European Pat. Off. . |
| 0613068A2 | 8/1994 | European Pat. Off. . |
| 0539003B1 | 6/1995 | European Pat. Off. . |

*Primary Examiner*—Patrick Ryan
*Assistant Examiner*—J. M. Gray
*Attorney, Agent, or Firm*—Sughrue, Mion, Zinn, Macpeak & Seas, PLLC

[57] ABSTRACT

A paper feed roll is formed of a rubber composition comprising (A) a composite material having a low molecular weight material retained in a medium material and (B) a rubber material. The low molecular weight material has a viscosity of up to $5\times10^5$ centipoise at 100° C. The difference in solubility parameter between the low molecular weight material and the medium material is up to 3.0. The weight ratio of the low molecular weight material to the medium material is at least 1.0. The difference in solubility parameter between the low molecular weight material and the rubber material is up to 4.0. A paper feed apparatus comprising the paper feed roll is also provided.

5 Claims, 2 Drawing Sheets

PAPER FEED ROLL AND APPARATUS

TECHNICAL FIELD

This invention relates to a roll for feeding sheets of paper (inclusive of tissue-like members other than paper) and a paper feed apparatus comprising the paper feed roll. More particularly, it relates to a paper feed roll for use in various apparatus having a paper feed mechanism, for example, business machines such as copying machines, laser printers, and facsimile machines as well as automatic teller machines (ATM), money exchangers, counters, vending machines, and cash dispensers (CD), the paper feed roll having anti-staining to paper, improved paper feed ability and durability and a paper feed apparatus comprising the paper feed roll.

BACKGROUND

Paper feed rolls for use in paper feed mechanisms mounted in paper feed units of copying machines or the like are required to have improved paper feed ability, cause no staining to sheets of paper interposed between rolls, and be fully durable. To meet these requirements, rolls of various shapes and materials have been proposed. Typical examples of the material of which rolls mounted in paper feed units are made are vulcanized rubbers and crosslinked elastomers such as silicone rubber, urethane rubber, styrene-butadiene rubber, butadiene rubber, and ethylene-propylene rubber.

In order to produce paper feed rolls having consistent paper feed ability, rubber compositions are typically loaded with large amounts of oil or plasticizer to produce low hardness rubber materials. The oil loading, however, has a number of problems. (1) Since oil is less miscible with other components during kneading, the rotor often rotates in vain. (2) Unvalcanized rubber with high oil loading is strongly sticky and tends to strongly adhere to the rotor or kneader, leading to less efficient operation. (3) As to physical properties, vulcanized rubber is substantially reduced in rupture strength. (4) Vulcanized rubber is increased in dependency of its physical properties on temperature. (5) Adhesion to metal is low. (6) Most importantly, migration of oil occurs in rubber products (that is, oil migrates to the interior and the surface of rubber) during long-term service, incurring problems of performance and appearance. In summary, paper feed rolls made of oil-loaded rubber suffer from several drawbacks including hindered paper feed performance, staining of paper sheets interposed between rolls, and poor wear resistance. Therefore, a certain limit exists in reducing the hardness of rubber material by oil loading, inhibiting optimum design of paper feed rolls.

In contrast, silicone rubber is improved in wear resistance, but undesirably fails to maintain a paper feed function because of a low coefficient of friction.

While business machines are required to increase printing speed and accommodate more types of paper, paper feed apparatus in such business machines are required to be more reliable and more durable. In particular, more strict requirements are imposed on paper feed rolls mounted in the paper feed apparatus with respect to durability during paper feed, that is, wear resistance and retention of a high coefficient of friction.

Therefore, an object of the present invention is to substantially eliminate the drawbacks of physical properties and workability resulting from conventional use of a large amount of oil to produce a low hardness rubber material suitable for the manufacture of paper feel rolls and to provide a paper feed roll which can maintain a high coefficient of friction and consistent paper feed ability during long-term service, has high wear resistance, and causes minimized staining to paper sheets interposed between rolls.

SUMMARY OF THE INVENTION

According to a first aspect of the present invention, a paper feed roll for use in a paper feed mechanism is formed of a rubber composition comprising (A) a composite material in which a low molecular weight material is retained in a medium material and (B) a rubber material. The low molecular weight material has a viscosity of up to $5\times10^5$ centipoise at 100° C. The difference in solubility parameter between the low molecular weight material and the medium material is up to 3.0. The weight ratio of the low molecular weight material to the medium material is at least 1.0. The difference in solubility parameter between the low molecular weight material and the rubber material is up to 4.0.

In a second aspect, the present invention provides a paper feed apparatus comprising a feed roll rotatable in a paper feed direction, a reverse roll opposed to said feed roller through a paper feed path and rotatable in a direction opposite to said paper feed direction, and a pickup roll for picking up the uppermost sheet of paper from a stack of paper sheets and delivering it to the feed roll wherein at least one of the rolls is a paper feed roll formed of the above-defined rubber composition.

In a third aspect, the present invention provides a paper feed apparatus comprising a paper feed roll for feeding a sheet of paper and a frictional separation member disposed adjacent the paper feed roll wherein the paper feed roll is formed of the above-defined rubber composition.

The paper feed roll-forming rubber composition defined herein is improved in wear resistance, paper feed ability as expressed by retention of a coefficient of friction, hardness, and staining to paper sheets in contact therewith. Paper feed rolls formed therefrom are fully durable. A paper feed apparatus having mounted a paper feed roll formed therefrom thus performs well.

BEST MODE FOR CARRYING OUT THE INVENTION

Figure 1:
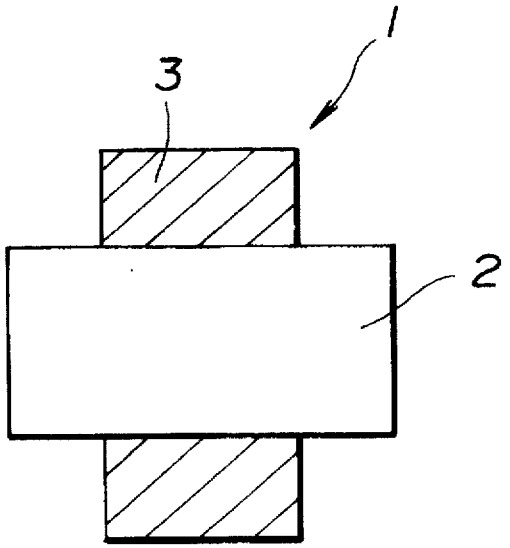
FIG. 1 is a schematic cross-sectional view of a paper feed roll according to one embodiment of the invention.

According to the present invention, a paper feed roll is formed of a rubber composition comprising (A) a composite material containing a low molecular weight material and a medium material and (B) a rubber material.

The low molecular weight material has a viscosity of up to $5\times10^5$ centipoise at 100° C., preferably up to $1\times10^5$ centipoise at 100° C. Differently stated, it has a number average molecular weight of up to about 20,000, preferably up to about 10,000, more preferably up to about 5,000. Typically low molecular weight materials which are liquid or substantially liquid at room temperature are used. Hydrophilic or hydrophobic low molecular weight materials are also acceptable.

Any of low molecular weight materials which meet the above-mentioned requirements may be used. Though not critical, the following exemplary materials are useful.

(1) Softening material: Softening materials for use in various rubbers and resins include mineral oil, vegetable oil and synthetic oil materials. The mineral oil materials include processing oils of aromatic, naphthene and paraffin systems. The vegetable oil materials include castor oil, cotton seed oil, linseed oil, colza oil, soybean oil, palm oil, coconut oil, peanut oil, haze tallow, pine oil, and olive oil.

(2) Plasticizer: Included are ester plasticizers such as phthalates, phthalic mixed esters, aliphatic dibasic acid esters, glycol esters, fatty acid esters, phosphates, and stearates; epoxy plasticizers; other plasticizers for plastics; and plasticizers for NBR such as phthalates, adipates, sebacates, phosphates, polyethers, and polyesters.

(3) Tackifier: Tackifiers include coumarone resins, coumarone-indene resins, phenol terpene resins, petroleum hydrocarbons, and rosin derivatives.

(4) Oligomer: Oligomers include crown ether, fluorinated oligomers, polyisobutyrene, xylene resin, chlorinated rubber, polyethylene wax, petroleum resin, rosin ester rubber, polyalkylene glycol diacrylates, liquid rubbers (e.g., polybutadiene, styrene-butadiene rubber, butadiene-acrylonitrile rubber, and polychloroprene), silicone oligomers, and poly-α-olefins.

(5) Lubricant: Included are hydrocarbon lubricants such as paraffin and wax; fatty acid lubricants such as higher fatty acids and oxyfatty acids; fatty acid amide lubricants such as fatty acid amides and alkylene bisfatty acid amides; ester lubricants such as fatty acid lower alcohol esters, fatty acid polyhydric alcohol esters and fatty acid polyglycol esters; alcohol lubricants such as aliphatic alcohols, polyhydric alcohols, polyglycols, and polyglycerols; metal soaps; and mixtures.

Other useful low molecular weight materials are latex, emulsion, liquid crystal, bitumen, clay, natural starch, saccharides, inorganic silicone oil, and phosphazine. Also included are animal oils such as beef tallow, lard, horse tallow, chicken oil, and fish oil; honey, fruit juice, chocolate, dairy products such as yogurt; organic solvents such as hydrocarbon, halogenated hydrocarbon, alcohol, phenol, ether, acetal, ketone, fatty acid, ester, nitrogen compound and sulfur compound solvents; various pharmaceutical components, soil modifiers, fertilizers, petroleum, water, and aqueous solutions. These materials may be used alone or in admixture.

The type and amount of low molecular weight material may be determined by taking into account the required properties and application of a rubber composition as well as compatibility with the remaining components, medium material and rubber material.

The medium material is a material having a function as a medium between the low molecular weight material and the rubber material. It is a key material in achieving the object of the present invention. In order to blend a large amount of the low molecular weight material with the rubber material so as to form a uniform composition, according to the present invention, a large amount of the low molecular weight material is first blended with the medium material to form a composite material, that is, a composite material of the medium material having a large amount of the low molecular weight material retained therein, and this composite material is then blended with the rubber material to form an end rubber composition which eventually has a large amount of the low molecular weight material retained therein. If the low molecular weight material, medium material and rubber material are simultaneously blended, there cannot be formed a uniform, low hardness rubber composition. If a large amount of the low molecular weight material is directly blended with the rubber material, there is obtained a rubber composition in which the low molecular weight material is non-uniformly blended and tends to bleed out, failing to produce a desired rubber composition having low hardness. The term "retention" of the low molecular weight material by the medium material and eventually by the rubber composition means that the low molecular weight material is uniformly dispersed in the medium material or rubber material and does little or not bleed out. A degree of bleeding can be readily controlled depending on the purpose of the rubber composition. Although the mechanism by which the composite material having the low molecular weight material retained therein is uniformly dispersed in the rubber material when they are blended is not well understood, it is believed that the composite material is finely divided into small grains which are retained in the rubber material.

Any desired medium material may be used as long as it has the above-mentioned function and can form a composite material having a large amount of the low molecular weight material retained therein. Typically thermoplastic polymers and compositions containing the same are used.

Examples of the medium material include thermoplastic elastomers such as styrene elastomers (e.g., butadiene-styrene and isobutylene-styrene), vinyl chloride elastomers, olefin elastomers (e.g., butadiene, isoprene and ethylene-propylene), ester elastomers, amide elastomers, and urethane elastomers as well as hydrogenated or otherwise modified products thereof; and thermoplastic resins such as styrene resins, ABS resins, olefin resins (e.g., ethylene, propylene, ethylene-propylene, ethylene-styrene, and propylene-styrene), vinyl chloride resins, acrylate resins (e.g., methyl acrylate), methacrylate resins (e.g., methyl methacrylate), carbonate resins, acetal resins, nylon resin, halogenated polyether resins (e.g., chlorinated polyethers), halogenated olefin resins (e.g., ethylene tetrafluoride, ethylene fluoride chloride, and fluorinated ethylene-propylene), cellulose resins (e.g., acetyl cellulose and ethyl cellulose), vinylidene resins, vinyl butyral resins, and alkylene oxide resins (e.g., propylene oxide) and rubber-modified products of these resins.

Preferred thermoplastic polymers are those polymers including both a hard block like a crystalline or agglomerated structure and a soft block like an amorphous structure. Illustrative examples are shown below.

(1) Block copolymers of polyethylene and an ethylene/butylene-styrene random copolymer which are obtained by hydrogenating a block copolymer of polybutadiene and a butadiene-styrene random copolymer (2) Block copolymers of polybutadiene and polystyrene, or block copolymers of polyethylene/butylene and polystyrene which are obtained by hydrogenating a block copolymer of polybutadiene or ethylene-butadiene random copolymer and polystyrene (3) Ethylene-propylene rubber (4) Block copolymers in the form of ethylene/butylene copolymers having a crystalline ethylene block attached at one or both ends thereof Preferred among these are block copolymers of polyethylene and an ethylene-styrene random copolymer.

Some of the low molecular weight material, medium material and low molecular weight material-retaining medium material composite material are described in JP-A 239256/1993 and 194763/1993. The medium materials having a three-dimensional continuous network skeleton structure disclosed in these patents are also typically used in the present invention.

The medium material used herein may be used in bulk, grain, gel, foam, or non-woven fabric form though not limited thereto. The medium material may have built therein capsules capable of enclosing the low molecular weight material.

In preparing a composite material containing a large amount of the low molecular weight material and the medium material, these two components are selected such that the difference in solubility parameter between the low molecular weight material and the medium material is up to 3.0, preferably up to 2.5. If the difference in solubility parameter exceeds 3.0, it becomes difficult from the compatibility point of view to effectively retain a large amount of the low molecular weight material, resulting in a rubber composition which is not fully reduced in hardness and which allows the low molecular weight material to bleed out.

The weight ratio of the low molecular weight material to the medium material is at least 1.0, preferably at least 2.0, more preferably at least 3.0. With a weight ratio of less than 1.0, it is difficult to obtain a low hardness rubber composition, failing to achieve the object of the invention.

Any desired method may be used in preparing the composite material of low molecular weight material and medium material depending on the type and properties of the two components and mixing ratio. An optimum method may be selected from well-known methods including the one described in JP-A 239256/1993.

The rubber material (B) may be selected from ethylene-propylene rubber (EPR, EPDM), butyl rubber, natural rubber (NR), isoprene rubber (IR), styrene-butadiene rubber (SBR), butadiene rubber (BR), nitrile rubber (NBR), chloroprene rubber (CR), silicone rubber, urethane rubber (UR), etc. alone or in admixture of two or more while taking into account the environmental conditions and required performance of paper feed rolls.

According to the present invention, the low molecular weight material and the rubber material are selected such that the difference in solubility parameter between the low molecular weight material and the rubber material is up to 4.0, preferably up to 3.0. Although the low molecular weight material is blended with the rubber material after it is converted into a composite material with the medium material, the compatibility between the low molecular weight material and the rubber material is still a problem. If the difference in solubility parameter exceeds 4.0, it becomes difficult from the compatibility point of view for the rubber material to effectively retain a large amount of the low molecular weight material retained in the composite material, resulting in a rubber composition which is not fully reduced in hardness and which allows the low molecular weight material to bleed out.

Any desired method may be used in blending the low molecular weight material-retaining composite material with the rubber material depending on the properties of the two components and mixing ratio. An optimum method may be selected from well-known methods.

The thus obtained rubber composition has a hardness which is controlled to any desired value in a relatively low hardness range. For example, the composition may be controlled to have a very low hardness as exemplified by an Ascar C hardness of up to 10° at 25° C.

Any desired conventional additive may be added to the rubber composition according to the present invention. Such additives include vulcanizing agents (e.g., sulfur and peroxides), vulcanization promoters (e.g., tetramethylthiuram monosulfide commercially available as NOXELER TS, mercaptobenzothiazole commercially available as NOXLER M, N-cyclohexyl-2-benzothiazylsulfenamide commercially available as NOXLER CZ, and diphenylguanidine commercially available as NOXLER G from Ouchi Sinko K.K.), vulcanization aids (e.g., ethylene glycol dimethacrylate EDMA, triallyl-isocyanurate TAIC, and N,N'-m-phenylene dimaleimide commercially available as VALNOK PM), fillers (e.g., carbon black, white carbon, and calcium carbonate), antioxidants (e.g., styrene-modified phenol commercially available as ANTAGE SP-P, 2,6-di-t-butyl-4-methylphenol commercially available as NOKLACK 200, and dibutyl hydrogen phosphite DBP), and antistatic agents (e.g., conductive carbon commercially available as KETJEN BLACK EC and white conductive powder). These additives are added to the rubber composition before it is vulcanized into a roll which is suitable for mounting in a paper feed apparatus as a paper feed roll.

If desired, fillers may be further blended in the rubber composition according to the invention. Exemplary fillers include flake inorganic fillers such as clay, diatomaceous earth, talc, barium sulfate, calcium carbonate, magnesium carbonate, metal oxides, mica, graphite, and aluminum hydroxide; granular or powder solid fillers such as metal powder, wood chips, glass powder, and ceramic powder; and natural and synthetic short and long fibers (e.g., straw, wool, glass fibers, metal fibers, and polymer fibers).

Preferably the rubber composition according to the invention contains 100 parts by weight of the rubber material (B) and up to 400 parts, more preferably 10 to 300 parts, most preferably 20 to 200 parts by weight of the low molecular weight material-medium material composite material (A) because of good workability into paper feed rolls and minimized losses. On this basis, less than 10 parts of composite material (A) would be too less to reduce the hardness of the rubber composition whereas more than 400 parts of composite material (A) would result in rolls being increased in creep and set.

The paper feed roll which is formed of the rubber composition generally has a hardness of up to 60°, preferably up to 50°, more preferably up to 40°, most preferably up to 30° on JIS A scale. The rubber composition can be designed and controlled so that it may have a hardness suited as paper feed rolls in paper feeders.

The paper feed roll according to the invention is not particularly limited in construction. It may be manufactured solely of the rubber composition defined above or by combining the rubber composition with a known polymeric material (inclusive of rubber material) or metallic material to form a layered structure. One exemplary structure of the paper feed roll is shown at 1 in FIG. 1 as comprising a shaft 2 and a rubber sleeve 3 of the rubber composition around the shaft.

The paper feed roll according to the invention may be provided with an abrasion pattern by machining and polishing its surface. Alternatively, a mold having a cavity surface engraved with a particular pattern is used whereby the pattern is transferred to the roll surface, obtaining a roll having a patterned surface which is more effective for paper feeding purpose.

As is well known, paper feed or transfer rubber rolls used in paper feed or transfer mechanisms are required to have consistent paper feed ability and not to stain paper sheets. In particular, paper transfer rolls in paper feed systems should preferably be formed of low hardness rubber materials for achieving effective paper transfer. In general, a rubber composition must be loaded with a large amount of oil before a low hardness rubber material can be manufactured. Then the following drawbacks are induced which prevent optimum design of paper transfer rubber rolls. (1) Since oil is less miscible with other components during kneading, the rotor often rotates in vain. (2) Unvalcanized rubber with high oil loading is strongly sticky and tends to strongly adhere to the rotor or kneader, leading to less efficient operation. (3) Vulcanized rubber is substantially reduced in rupture strength. (4) Vulcanized rubber is increased in dependency of its physical properties on temperature. (5) Adhesion to metal is low. (6) Most importantly, migration of oil occurs in rubber products (that is, oil migrates to the interior and the surface of rubber) during long-term service, incurring problems of performance and appearance. Paper feed rolls made of oil-loaded rubber suffer from several drawbacks including hindered paper feed performance, staining of paper sheets interposed between rolls, and poor wear resistance.

According to the invention, paper feed rolls are formed of a rubber composition comprising, in admixture, low molecular weight material-retaining medium material composite material (A) and rubber material (B). The hardness of this rubber composition can be readily controlled by changing the mixing ratio of components (A) and (B). Since the low molecular weight material-retaining medium material composite material (A) playing the role of reducing hardness is dispersed in rubber material (B), bleeding of the low molecular weight material is minimized.

The paper feed roll according to the invention has stable paper feed ability and causes little staining to objects, typically paper sheets, interposed between the rolls. Blending of composite material (A) and rubber material (B) can be readily done within a short time, paper feed rolls are manufactured with high productivity.

Figure 3:
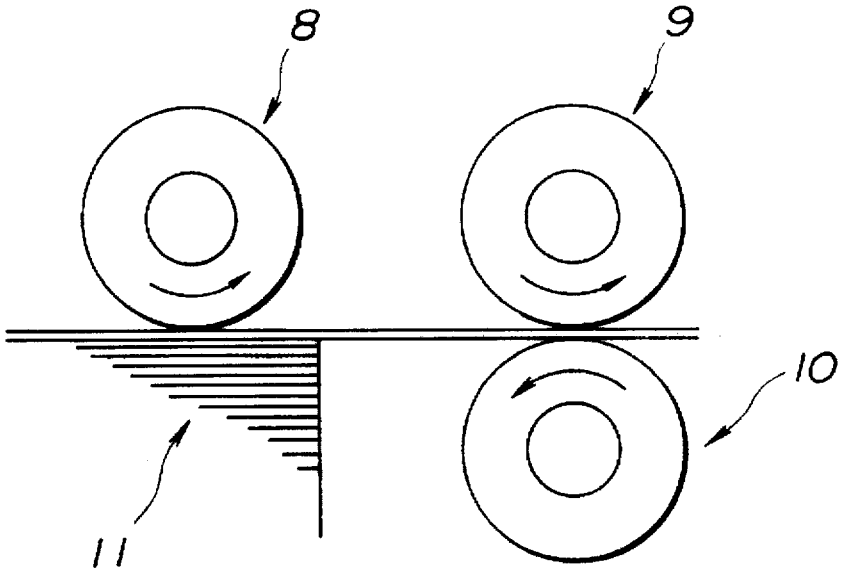
FIG. 3 schematically illustrates a paper feeder.

FIG. 3 shows a paper feed apparatus comprising a feed roll 9 rotatable in a paper feed direction, a reverse roll 10 opposed to the feed roller through a paper feed path and rotatable in a direction opposite to said paper feed direction, and a pickup roll 8 for picking up the uppermost sheet of paper from a stack of paper sheets 11 and delivering it to the feed roll. This apparatus is designated paper feeder I.

Figure 4:
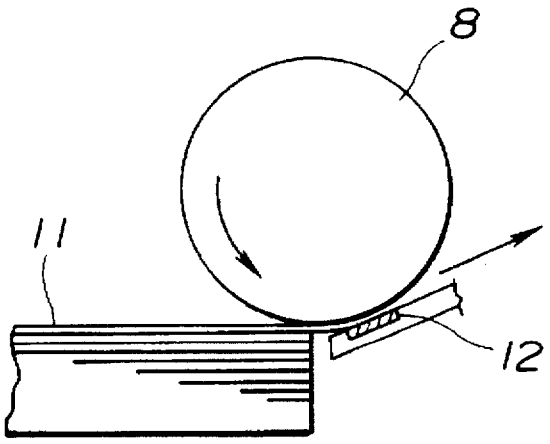
FIG. 4 schematically illustrates another paper feeder.

FIG. 4 Shows another paper feed apparatus comprising a paper feed roll 8 for feeding a sheet of paper 11 and a frictional separation pad 12 disposed adjacent the paper feed roll 8. This apparatus is designated paper feeder II.

In both the embodiments, at least one, preferably all of the rolls is a paper feed roll formed of the rubber composition defined herein.

EXAMPLE

Examples of the present invention are given below by way of illustration and not by way of limitation. All parts are by weight Paper feed rolls were manufactured by vulcanizing rubber compositions formulated as shown in Table 1. The paper feed rolls were examined for physical properties and tested by mounting them in a paper feeder.

The rubber compositions were prepared by previously blending rubber with calcium carbonate, sulfur and promoter, and blending the rubber with a low molecular weight material in Comparative Examples or with a low molecular weight material-retaining medium material composite material in Examples in a Brabender at 50° C. and 50 rpm.

EXAMPLE 1

Naphthene oil (SUNTHENE 430 manufactured by Nihon Sun Sekiyu K.K.) as a low molecular weight material was blended with hydrogenated SBR (a block copolymer with a molecular weight of 130,000 of polyethylene and an ethylene-styrene random copolymer which was obtained by hydrogenating a block copolymer of a butadiene-styrene random copolymer and polybutadiene) as a medium material to form a composite material in which the low molecular weight material was retained in the medium material. Then 100 parts of a composite material was blended with 100 parts of EPDM rubber (NORDEL 1040 manufactured by E.I. dupont) in a Brabender mixer, obtaining a rubber composition.

During mixing in the Brabender mixer, idling of the rotor without effective mixing and strong adhesion of rubber to the rotor could be avoided. Mixing was readily completed within a short time (15 minutes).

The rubber composition was placed in a mold cavity and vulcanized and cured at 160° C. for 30 minutes to form a paper feed rubber roll. The roll was tested by mounting it in a paper feeder I.

EXAMPLE 2

A rubber composition was prepared as in Example 1 except that paraffin oil (SUNPAR 2280 manufactured by Nihon Sun Sekiyu K.K.) was used as a low molecular weight material instead of the naphthene oil in Example 1 and 200 parts of a composite material having the paraffin oil retained in hydrogenated SBR was blended with 100 parts of EPDM rubber in a Brabender mixer.

As in Example 1, mixing could be readily completed within a short time (15 minutes). The rubber composition was similarly vulcanized and cured to form a paper feed rubber roll, which was tested by mounting it in a paper feeder I.

EXAMPLE 3

A rubber composition was prepared as in Example 1 except that 100 parts of a composite material having dioctyl adipate (low molecular weight material) retained in hydrogenated SBR was blended with 100 parts of natural rubber (NR) in a Brabender mixer.

As in Example 1, mixing could be readily completed within a short time (15 minutes). The rubber composition was placed in a mold cavity and vulcanized and cured at 145° C. for 30 minutes to form a paper feed rubber roll, which was tested by mounting it in a paper feeder I.

EXAMPLE 4

A rubber composition was prepared as in Example 1 except that 100 parts of a composite material having aroma oil (low molecular weight material) retained in hydrogenated SBR was blended with 100 parts of styrene-butadiene rubber (SBR) in a Brabender mixer.

As in Example 1, mixing could be readily completed within a short time (15 minutes). The rubber composition was placed in a mold cavity and vulcanized and cured at 150° C. for 30 minutes to form a paper feed rubber roll, which was tested by mounting it in a paper feeder I.

EXAMPLE 5

A rubber composition was prepared as in Example 1 except that 100 parts of a composite material having naphthene oil (Sunthene 430 manufactured by Nihon Sun Sekiyu K.K.) as a low molecular weight material retained in EPDM rubber (EP01 by Japan Synthetic Rubber Co. Ltd.) was blended with 100 parts of EPDM rubber (NORDEL 1040 by E.I. dupont) in a Brabender mixer.

As in Example 1, mixing could be readily completed within a short time (15 minutes). The rubber composition was similarly vulcanized and cured to form a paper feed rubber roll, which was tested by mounting it in a paper feeder I.

EXAMPLE 6

The paper feed roll manufactured in Example 1 was tested by mounting it in a paper feeder II.

COMPARATIVE EXAMPLE 1

A rubber composition was prepared as in Example 1 except that instead of the composite material, 100 parts of naphthene oil (SUNTHENE 430 manufactured by Nihon Sun Sekiyu K.K.) as a low molecular weight material was blended with 100 parts of EPDM rubber in a Brabender mixer. During mixing in the Brabender mixer, the rotor idled due to lubrication by the oil. Thus the oil was added and blended by small increments so that mixing took a long time (1 hour). The rubber composition was similarly vulcanized and cured to form a paper feed rubber roll, which was tested by mounting it in a paper feeder I.

COMPARATIVE EXAMPLE 2

A rubber composition was prepared as in Example 2 except that instead of the composite material, 200 parts of paraffin oil (SUNPAR 2280 manufactured by Nihon Sun Sekiyu K.K.) as a low molecular weight material was blended with 100 parts of EPDM rubber in a Brabender mixer. During mixing in the Brabender mixer, the rotor idled due to lubrication by the oil. Thus the oil was added and blended by small increments. However, when the total amount of oil exceeded 100 parts, the rotor idled and mixing action was no longer effective, failing to produce a desired rubber composition.

COMPARATIVE EXAMPLE 3

The paper feed roll manufactured in Comparative Example 1 was tested by mounting it in a paper feeder II.

The paper feed rolls manufactured in Examples 1 to 6 and Comparative Examples 1 and 3 were examined by the following tests.

Hardness

A block sample sized 25×25×55 mm (thick) prepared under the same conditions as each paper feed roll was measured for hardness by the hardness test (A type) according to JIS K-6301.

Stain resistance

A roll was placed on a copying plain paper sheet under a load of 1 kgf in an atmosphere at 70° C. for 24 hours. Then both the plain paper and the roll was visually observed for stain on their surface.

Maintenance of frictional force

Figure 2:
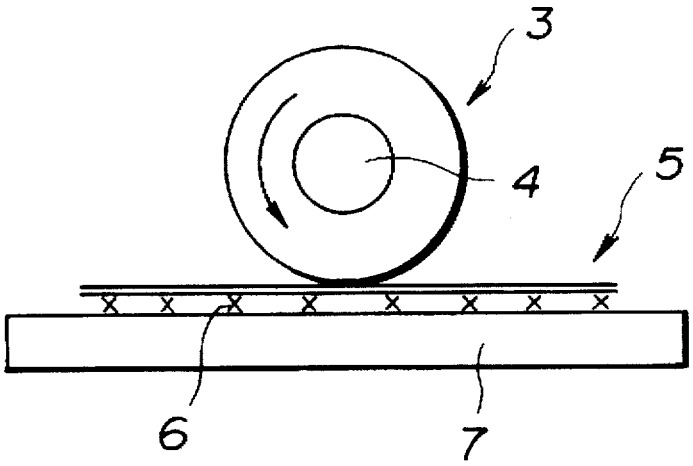
FIG. 2 schematically illustrates how to measure the frictional force of a paper feed roll in contact with paper.

A frictional force measurement device as shown in FIG. 2 was used. A roll 3 was attached to the device by fastening bolts 4. A plain paper sheet 5 was fixedly secured to an iron base 7 through double adhesive tape 6. With the roll 3 in contact with the paper sheet 5 under a load of 500 gf, the roll was rotated at a circumferential speed of 400 mm/sec. The frictional force exerted between the roll and the paper was measured by a load cell.

Next, a roll was mounted in a paper feeder for a copying machine as shown in FIG. 3 or 4. The machine was operated to feed 10,000 sheets of plain paper (A4 size) in a longitudinal direction. Thereafter, the roll was mounted to the frictional force measurement device shown in FIG. 2 again to measure the frictional force of the used roll. The ratio of the frictional force after paper feed to the initial frictional force was evaluated as friction maintenance.

Wear

A roll was mounted in a paper feeder for a copying machine as shown in FIG. 3 or 4. The machine was operated to feed 10,000 sheets of plain paper (A4 size) in a longitudinal direction. A change of roll radius was calculated from a weight reduction after the paper feed operation from the initial weight. This change is reported as a wear resulting from the paper feed operation.

TABLE 1

| | Example | | | | | | Comparative Example 1 | | |
|---|---|---|---|---|---|---|---|---|---|
| | 1 | 2 | 3 | 4 | 5 | 6 | 1 | 2 | 3 |
| Rubber composition[1] (pbw) Rubber | | | | | | | | | |
| EPDM (NORDEL 1040) | 100 | 100 | — | — | 100 | 100 | 100 | 100 | 100 |
| Natural rubber (NR) | — | — | 100 | — | — | — | — | — | — |
| Styrene butadiene rubber (SBR 1502) | — | — | — | 100 | — | — | — | — | — |
| Composite material | 100 | 200 | 100 | 100 | 100 | 100 | LMW 100 | LMW 100 | LMW 100 |
| Medium material | H-SBR[2] | H-SBR[2] | H-SBR[2] | H-SBR[2] | EPDM[3] | H-SBR[2] | — | — | — |
| LMW material | naphthene oil[4] | paraffin oil[5] | dioctyl adipate | aroma oil | naphthene oil[4] | naphthene oil[4] | naphthene oil[4] | paraffin oil[5] | naphthene oil[4] |
| Calcium carbonate | 40 | 40 | 40 | 40 | 40 | 40 | 40 | 40 | 40 |
| Sulfur | 1.2 | 1.2 | 1.2 | 1.2 | 1.2 | 1.2 | 1.2 | 1.2 | 1.2 |
| Paper feeder | I | I | I | I | I | II | I | — | II |
| Material properties | | | | | | | | | |
| Workability[6] | O | O | O | O | O | O | X | unmoldable | X |
| Anti-staining[7] | O | O | O | O | O | O | X | — | X |
| Hardness, JIS A | 25 | 20 | 20 | 20 | 25 | 25 | 25 | — | 25 |
| Roll properties | | | | | | | | | |
| Friction maintenance | | | | | | | | | |

TABLE 1-continued

| | Example | | | | | | Comparative Example 1 | | |
|---|---|---|---|---|---|---|---|---|---|
| | 1 | 2 | 3 | 4 | 5 | 6 | 1 | 2 | 3 |
| Pickup roll | 0.98 | 0.98 | 0.85 | 0.90 | 0.95 | 0.98 | 0.82 | — | 0.82 |
| Feed roll | 0.98 | 0.98 | 0.85 | 0.90 | 0.95 | — | 0.82 | — | — |
| Reverse roll | 0.99 | 0.99 | 0.92 | 0.93 | 0.98 | — | 0.92 | — | — |
| Wear (x $10^{-3}$ cm) | — | | | | | | | | |
| Pickup roll | 20 | 25 | 22 | 20 | 25 | 25 | 30 | — | 38 |
| Feed roll | 20 | 25 | 22 | 20 | 25 | — | 30 | — | — |
| Reverse roll | 50 | 70 | 55 | 50 | 65 | — | 82 | — | — |
| Jamming during feeding of 10,000 sheets | no | no | no | no | no | no | 2 times | — | 3 times |

Note:
[1]A rubber composition was prepared by previously blending rubber with calcium carbonate, sulfur and promoter, and blending the rubber with a low molecular weight material or a low molecular weight material-retaining medium material composite material.
[2]A block copolymer with a molecular weight of 130,000 of polyethylene and an ethylene-styrene random copolymer was obtained by hydrogenating a block copolymer of a butadiene-styrene random copolymer and polybutadiene.
[3]EP01 manufactured by Japan Synthetic Rubber Co. Ltd.
[4]SUNTHENG 430 manufactured by Nihon Sun Sekiyu K.K.
[5]SUNPAR 2280 manufactured by Nihon Sun Sekiyu K.K.
[6]Workability and processability O: good X: poor
[7]Staining of roll itself and to paper sheet O: no staining X: stained As is evident from Table 1, the paper feed roll formed from a rubber composition comprising a low molecular weight material-holding medium material composite material and a rubber material according to the invention maintains frictional forces even after paper feed operation, has effective paper feed and transfer ability, receives little or no stain on its surface, and causes little or no stain to paper sheets. In addition, the rubber composition can be easily processed into a roll with high productivity. A paper feeder having such a paper feed roll mounted therein performs well in picking up, feeding and transferring sheets of paper.

There has been described a paper feed roll having stable paper feed and transfer abilities and causes no or little stain to objects to be fed forward by the roll, typically paper sheets. The paper feed roll is useful in any machinery having a paper feeding mechanism including business machines, typically copying machines and printers. A paper feed apparatus having the paper feed roll mounted finds use in any machine having a mechanism for picking up, feeding or transferring paper sheets. Although paper is described herein, thin sheets of any material other than paper can also be dealt with.

Although some preferred embodiments have been described, many modifications and variations may be made thereto in the light of the above teachings. It is therefore to be understood that within the scope of the appended claims, the invention may be practiced otherwise than as specifically described.

The Invention claimed is:

1. A paper feed roll, said roll being formed of a rubber composition comprising (A) a composite material having a low molecular weight material uniformly dispersed in a medium material without substantially bleeding out, and (B) a rubber material, wherein said low molecular weight material has a viscosity of up to $5\times10^5$ centipoise at 100° C., the difference in solubility parameter between said low molecular weight material and said medium material is up to 3.0, the amount of the low molecular weight material is at least the same as the amount of the medium material, wherein the amounts are on a weight basis, and the difference in solubility parameter between said low molecular weight material and said rubber material is up to 4.0; and wherein the low molecular weight material has a number average molecular weight of up to about 20,000, and wherein said medium material is selected from the group consisting of thermoplastic elastomers and thermoplastic resins, and the composite material is blended with the rubber material.

2. The paper feed roll of claim 1, wherein the low molecular weight material is selected from the group consisting of softening materials, plasticizers, tackifiers, oligomers, lubricants, latexes, emulsions, liquid crystals, bitumens, clays, natural starches, saccharides, inorganic silicone oils, phosphazines, animal oils, organic solvents, petroleums, water and aqueous solutions.

3. The paper feed roll of claim 1, wherein the rubber is selected from the group consisting of ethylene-propylene rubbers, butyl rubbers, natural rubbers, isoprene rubbers, styrene-butadiene rubbers, butadiene rubbers, nitrile rubbers, chloroprene rubbers, silicone rubbers and urethane rubbers.

4. The paper feed roll of claim 1, wherein the rubber composition contains 100 parts by weight of the rubber material and 20 to 200 parts by weight of the composite material.

5. The paper feed roll of claim 1, wherein the roll has a hardness of up to 30° on JIS A scale.

* * * * *